United States Patent [19]

Sanders

[11] Patent Number: 4,637,411

[45] Date of Patent: Jan. 20, 1987

[54] HAIRDRESSER'S AID

[75] Inventor: Bernard Sanders, St. Peter, Channel Islands

[73] Assignee: Raynham Investments Limited, Jersey, Channel Islands

[21] Appl. No.: 597,596

[22] Filed: Apr. 6, 1984

[30] Foreign Application Priority Data

Apr. 11, 1983 [GB] United Kingdom ..... 8309719

[51] Int. Cl.[4] ..... A45D 7/00

[52] U.S. Cl. ..... 132/9

[58] Field of Search ..... 132/1 R, 7, 9, 88.5, 132/88.7, 45 R, 45 A, 38 R, 39, 40, 41 R; 139/9, 45 R

[56] References Cited

U.S. PATENT DOCUMENTS

| | | | |
|---|---|---|---|
| 4,149,551 | 4/1979 | Benjamin et al. | 132/7 |
| 4,196,741 | 4/1980 | Minghenelli | 132/9 |
| 4,414,991 | 11/1983 | Marcotte | 132/45 R |
| 4,483,354 | 11/1984 | Marcotte | 132/45 R |

FOREIGN PATENT DOCUMENTS

| | | | |
|---|---|---|---|
| 63430 | 10/1982 | European Pat. Off. . | |
| 2096460 | 10/1982 | United Kingdom | 132/9 |
| 2096461 | 10/1982 | United Kingdom . | |

*Primary Examiner*—Hugh R. Chamblee

*Attorney, Agent, or Firm*—Neuman, Williams, Anderson & Olson

[57] ABSTRACT

A hairdresser's masking sheet is provided having flexible substrate and securing material carried thereby for effecting rapid and accurate initial attachment to strands of a head of hair and for effecting rapid removal therefrom after treatment.

2 Claims, 14 Drawing Figures

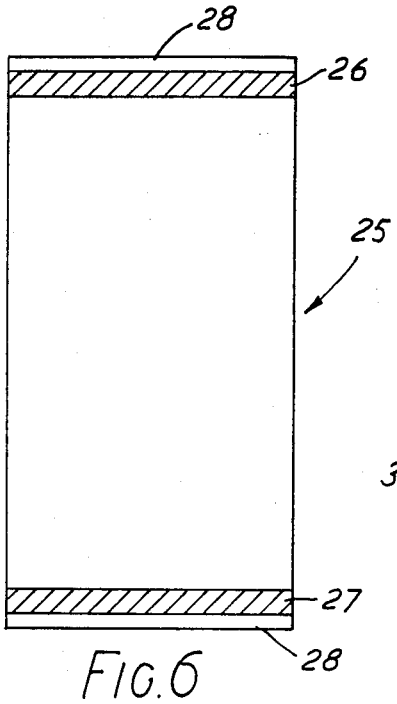
FIG. 6
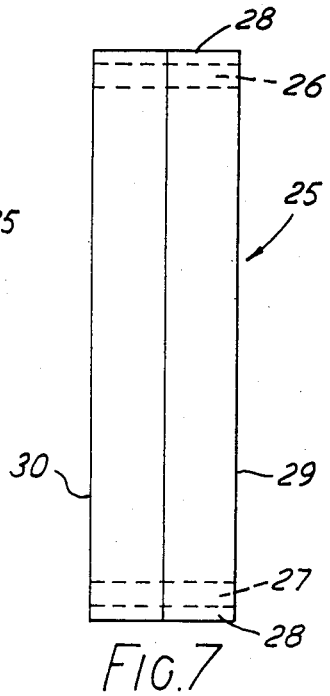
FIG. 7
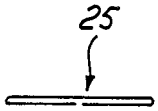
FIG. 8
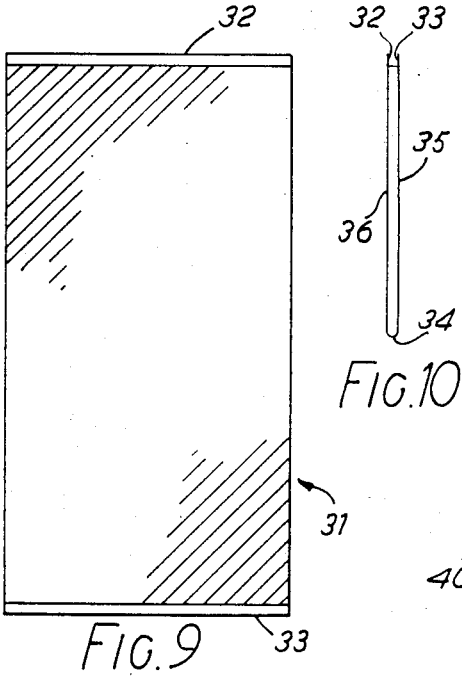
FIG. 9
FIG. 10
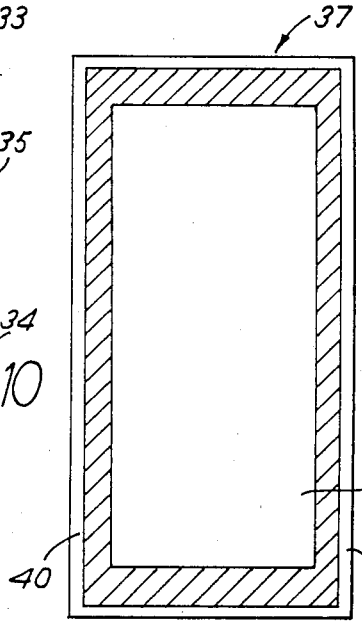
FIG. 11
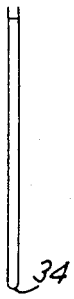
FIG. 12

HAIRDRESSER'S AID

BACKGROUND OF THE INVENTION

This invention relates to a hairdresser's aid and, more particularly, to a masking sheet of flexible material for masking selected strands of a head of hair from other strands of the hair while the selected strands are treated, such as by being subjected to a setting process and/or to a bleaching or coloring process.

A well known technique for treating strands of a head of hair is to apply to the head a cap having a plurality of apertures through which strands of hair are drawn by means of a hook. The strands of hair which project through the apertures are treated while the strands of the head of hair remaining beneath the cap are masked by the cap and therefore are not treated. After treatment, the cap is removed from the head and drawn away from the treated strands.

A disadvantage of using such a cap is that the process of drawing strands of hair through apertures in the cap and subsequent removal of the cap from the head often causes discomfort to the person wearing the cap. A further disadvantage is that such caps generally are not transparent and, in consequence, a hairdresser is unable to see which strands of hair to select for treatment.

In lieu of such a cap, another embodiment of a hairdressing aid has heretofore been proposed which utilizes a perforated strip which forms part of or is secured or securable to a sheet, sleeve or bag into which hair pulled through the perforations of the strip can be wrapped after it has been treated with dye or like coloring material.

In practice, a plurality of such strips would be used in treating a head of hair and, since each strip is elongate, it is easier to place each strip adjacent a portion of the hair from which strands of the hair will be selected for treatment. Each perforated strip is located relative to the head of hair by means of a plurality of clips and strands of hair are pulled through the perforations by means of a hooked needle and are masked from remaining portion of the head of hair by means of the sheet, sleeve or bag corresponding to the strip.

In another prior hairdressing aid, the strip is formed by a layer of double sided adhesive tape which itself is bonded to an edge region of a plastic sheet, or a sleeve or an opening in a flat plastics sheet material bag and perforations are formed through the sheet material and the double sided adhesive strip. It is stated that the slight adhesion which inevitably occurs between the hair which has been pulled through the perforations and the exposed surface of the adhesive strip assists in holding the edge region forming the strip against the wearer's head.

Although the latter hairdressing aid provides for greater flexibility than a perforated cap in that perforated strips may be secured by corresponding clips in the region of strands of hair which are to be selected for treatment, the perforated strip still suffers from the disadvantages referred to above, namely that the process of using the perforated strip still requires drawing of strands of hair through apertures causing discomfort to the person whose hair is being treated and the hairdresser being unable to see which strands of hair to select for treatment. Even if the perforated strip were to be of transparent material, the strands of hair can only be treated subsequent to application of the perforated strip to the region of the head of hair which includes the strands to be treated and the strands subsequently can only be drawn out by inserting a hooked needle through the perforations of the strip and manipulating the needle so as to pull through the apertures strands of hair generally in the region of the head of hair which is to be treated. It is somewhat a chance affair selecting strands of hair to be treated because application of a strip flattens the hair below the strip and the strands to be treated are drawn from a swirl of strands below the strip.

Furthermore, even though the prior embodiment utilizing the perforated strip formed by a layer of double sided adhesive tape effects a slight adhesion between hair pulled through the perforations and the exposed surface of the adhesive and thereby assists in holding the edge region forming the strip against the wearer's head, it is still necessary to locate the strip on the hair by means of additional clips. Also, it is not possible to locate the strip in abutment with the scalp of the head with a result that lower portions of the treated strands between the strip and the scalp may not be subjected to the treatment. If the treatment is a coloration process, such lower portions of the treated strands will not be colored and the result of the process will be unsatisfactory.

A further disadvantage of utilizing perforated strips is that application of the strips to a head of hair, i.e., clipping the strips to the hair and manipulating a hooked needle to draw strands of the hair through apertures, and removing the strips from the hair after treatment, i.e., removing the clips and pulling the strips from the treated strands, would be time consuming.

SUMMARY OF THE INVENTION

The hairdresser's aid of the present invention readily avoids the aforementioned problems and disadvantages of the prior art.

It is an object of the invention, therefore, to provide a hairdresser's masking sheet of flexible material for masking selected strands of a head of hair from other strands of the hair while the selected strands are treated wherein the strands are selected for treatment by attachment to the sheet rather than by initially attaching a sheet to a portion of hair of a head of hair which would include strands to be treated and thereafter attempting to randomly select strands from below the sheet.

It is also an object to provide an improved masking sheet wherein application of the sheet to selected strands and subsequent removal therefrom is less time consuming than the application and removal of hairdresser's aids known and/or proposed hitherto.

Other objects, advantages and features of the present invention will become apparent upon reading the detailed description and appended claims, and upon reference to the accompanying drawings.

The present invention provides a masking sheet comprising a substrate of flexible material and securing means carried by the substrate whereby application of the securing means to a portion of hair of a head of hair selectively and removably unites with strands of the portion of hair thereby brought into contact therewith.

The securing means permits accurate location of a masking sheet relative to selected strands of hair so that the sheet abuts the scalp of a head, if coloration of selected strands is required, and thereby ensures that the whole of the strands outwardly from the scalp are treated and also permits accurate location of the sheet in a longitudinal direction of selected strands in spaced relation to the scalp so that only lower portions of the selected strands between the scalp and the sheet are treated, the remaining portions of the strands being masked from the treating process by the sheet.

Such simultaneous accurate location and securing of a hairdresser's aid relative to selected strands of hair is not possible with hairdressers' aids known and/or processed hitherto.

DESCRIPTION

Following is a description, by way of example only and with reference to the accompanying drawings, of one method of carrying the invention into effect.

FIG. 6 is a plan view of a third embodiment of a sheet in accordance with the present invention.

FIG. 7 is a plan view of the sheet shown in FIG. 6 in a folded condition.

FIG. 8 is an inverted sectional view of the sheet shown in FIG. 7.

FIG. 9 is a plan view of a fourth embodiment of a sheet in accordance with the present invention.

FIG. 10 is a cross section of the sheet shown in FIG. 9 in a folded condition.

FIG. 11 is a plan view of a fifth embodiment of a sheet in accordance with the present invention.

FIG. 12 is a cross section of the sheet shown in FIG. 11 in a folded condition.

Figure 1:
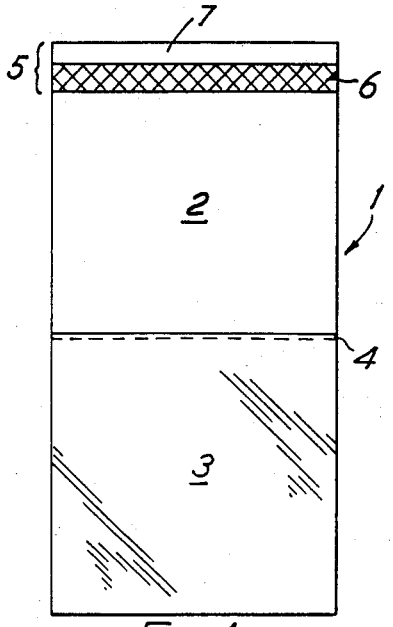
FIG. 1 is a plan view of one embodiment of a sheet in accordance with the present invention.
Figure 2:
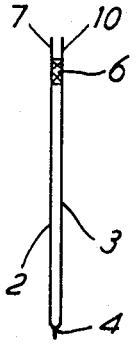
FIG. 2 is a cross section of the sheet shown in FIG. 1 in a folded condition.
Figure 3:
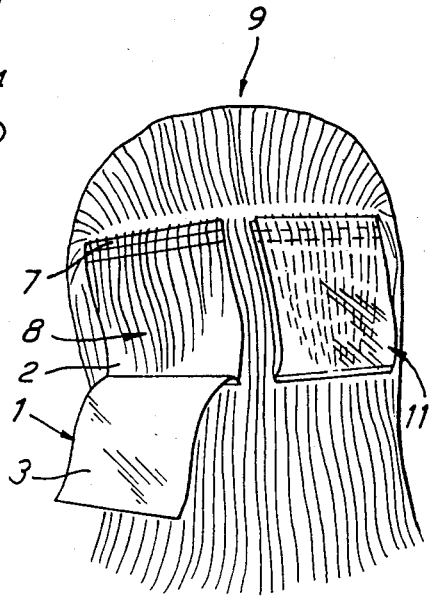
FIG. 3 is a diagrammatic representation of the sheet in use.

Referring now to FIGS. 1 to 3 of the drawings, there is shown a rectangular elongate sheet 1 comprising a rectangular panel 2 of white substantially opaque polyolefin material and a rectangular panel 3 of substantially transparent polyolefin material. The panels 2 and 3 are of substantially equal area and are affixed to another along a common edge, or co-extruded, to form a transversely extending hinge 4. An upper traverse marginal edge portion 5 of the panel 2 is provided with a strip of pressure sensitive contact adhesive 6 applied to a surface thereof so as to extend transversely of the panel 2 and spaced inwardly from an adjacent longitudinal edge thereof to provide a margin 7 free of adhesive.

In use, strands of a head of hair are selected by a technique known as "weaving" and the panel 2 is place under selected strands of hair, as shown at 8 in FIG. 3, of a head of hair 9 such that the margin 7 is located adjacent the scalp of the head 9. The adhesive 6 adheres to the selected strands of hair 8 adjacent the scalp such that the panel 2 is located under the selected strands of hair 8.

The selected strands of hair 8 subsequently are coated with a liquid coloring substance and the panel 3 is folded about the hinge 4 and is superimposed on the panel 2 with the selected strands of hair 8 located there between. A transverse marginal edge portion of the panel 3 adheres to the marginal edge portion 5 of the panel 2 by means of the adhesive 6 such that a margin 10 of the panel 3 is located adjacent the margin 7.

In this manner, the selected strands of hair 8 are located within an envelope 11 defined by the panels 2 and 3, the hinge 4 and the adhesive 6, and as shown in FIG. 3 are, thus, isolated from adjacent strands of the hair while coloration of the selected strands of hair is completed.

The process may be repeated with further selected strands of hair.

The fact that the panel 3 is substantially transparent enables a hairdresser to monitor the coloration process of the selected strands of hair without having to remove an envelope 11 from the selected strands. The panel 2 also assists in the monitoring process because the white substantially opaque characteristics of the panel mask strands of hair underlying the panel 2 from the selected strands. However, the adhesive 6 preferably is a re-usable adhesive so that, if necessary, the hairdresser may peel the panel 2 and 3 apart and examine the selected strands of hair to establish whether the coloration process is complete. If the process is not complete, then the hairdresser may re-apply the panel 3 to the panel by means of the adhesive 6.

Separation of the panels 2 and 3 is facilitated by means of the margins 7 and 10 which provide finger tabs whereby the margins 7 and 10 easily can be grasped and pulled in opposite directions one from another.

The margin 5 may be in the form of a tape which is applied to material which will comprise the remainder of the sheet 1 by means of the adhesive 6, there being a sufficient portion of the area of the adhesive 6 remaining exposed to achieve performance of the sheet 1. The material of the tape may be less flexible than the material comprising the remainder of the sheet 1 so as to provide the sheet 1 with a "stiff" portion for location adjacent the scalp of the head 9 when the sheet 1 is in use. Alternatively, such a "stiff" portion may be provided by increasing the thickness of the sheet 1 in the portion carrying the adhesive 6.

The adhesive 6 may have applied thereto a cover strip (not shown) having a release coating in contact with the adhesive. In use, the cover strip is peeled from the adhesive so as to expose the adhesive ready for use.

It will be appreciated that use of a cover strip facilitates stacking of sheet 1 at a storage location ready for use.

The margin 5 may be tinted so as to identify the portion of the sheet 1 carrying the adhesive 6 and/or the adhesive 6 may be tinted.

The panel 2 may be of less flexible material than the panel 3 so as to provide support for selected strands of hair when being treated.

Figure 4:
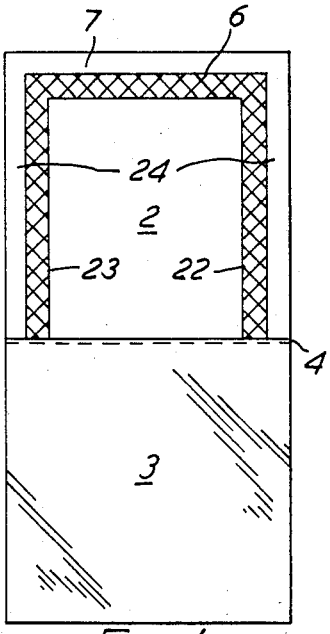
FIG. 4 is a plan view of a second embodiment of a sheet in accordance with the present invention.
Figure 5:
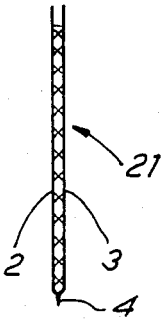
FIG. 5 is a cross section of the sheet shown in FIG. 4 in a folded condition.

Referring now to FIGS. 4 and 5 of the drawings, there is shown another embodiment of a sheet 21 which is similar to the sheet 1 except that the panel 2 is provided with additional longitudinally extending spaced parallel strips 22, 23 of adhesive each spaced inwardly from a corresponding adjacent marginal edge of the sheet 21 to provide a finger tab 24.

In use, the sheet 21 is folded in similar manner to the sheet 1 to envelop selected strands of hair to which the sheet 21 has been applied by the portion of the adhesive 6 and the spaced parallel strips 22, 23 of adhesive cause opposite facing marginal portions of the panels 2 and 3 to unite one with another with the result that the selected strands of hair are contained within a sealed envelope.

Referring now to FIGS. 6 and 7 of the drawings, there is shown a sheet 25 which is of similar dimensions to the sheets 1, 21 but is provided with spaced parallel transversely extending strips of cold seal adhesive 26, 27 adjacent opposite transverse edges respectively of the sheet 25. The adhesive strips 26 and 27 are spaced inwardly of the corresponding transverse edges to provide margins 28. The term "cold seal adhesive" means adhesive which adheres only to itself.

In use, the sheet 25 is folded transversely, so that the adhesive strips 26, 27 united one with another or, alternatively, the sheet is folded longitudinally about two folds 29, 30, as shown in FIG. 7, whereby superimposed portions of the adhesive strip 26 unite one with another and superimposed portions of the adhesive strip 27 also unite one with another. The margins 28 provide finger tabs for easily removing the folded sheet 25 from the accommodated strands of hair.

Referring now to FIGS. 9 and 10 of the drawings, there is shown a sheet 31 which is of similar dimensions to the sheets 1, 21 and 25 but the whole of one surface of the sheet 31, save for opposite spaced transversely extending marginal portions 32, 33, is coated with a cold seal adhesive.

In use, the sheet 31 is folded about a transverse fold 34 to provide two layers 35, 36 each having a surface of cold seal adhesive facing a similar surface of the other layer and each having projecting finger tabs 32, 33. When the layers 35, 36 are pressed into engagement with one another to envelop selected strands of hair, the layers adhere one to another due to the characteristics of the cold seal adhesive, except for the finger tabs 32, 33 and the areas in contact with the selected strands of hair.

Referring now to FIGS. 11 and 12 of the drawings, there is shown a sheet 37 similar to the sheet 31 in that one surface thereof is coated with a cold seal adhesive except that the sheet 37 is provided with a central rectangular portion 38 and two spaced parallel marginal portions 39, 40, which are clear of the adhesive. The marginal portions 39, 40 provide finger tabs for grasping and separating one from another layers of the sheet when folded to envelop selected strands of hair.

The material of the sheets 1, 21, 25, 31 and 37 may be such that, when each sheet is arranged to form an envelope containing the selected strands, the material permits heat emanating from the head 9 to pass through the material into the envelope but restrains passage of heat through the material from the envelope. Such effect may be achieved by providing each sheet 1, 21, 25, 31 and 37 in the form of two panels, one of which is opaque and the other of which is clear, the opaque panel being of a foam material and/or having a surface, which would comprise an inner surface of an envelope, with heat reflective characteristics. With such an envelope, heat dissipated from a head of hair being treated will pass inwardly through the material of the envelope but not outwardly from the envelope and will thus assist in the process of treatment of selected strands of the hair contained within the envelope, which process is enhanced by the presence of an environment at elevated temperature.

The folds 29, 30 and 34 of the sheets 25, 31 and 37 may be formed by means of a fold line provided by perforating or creasing the material of the sheets.

Figure 13:
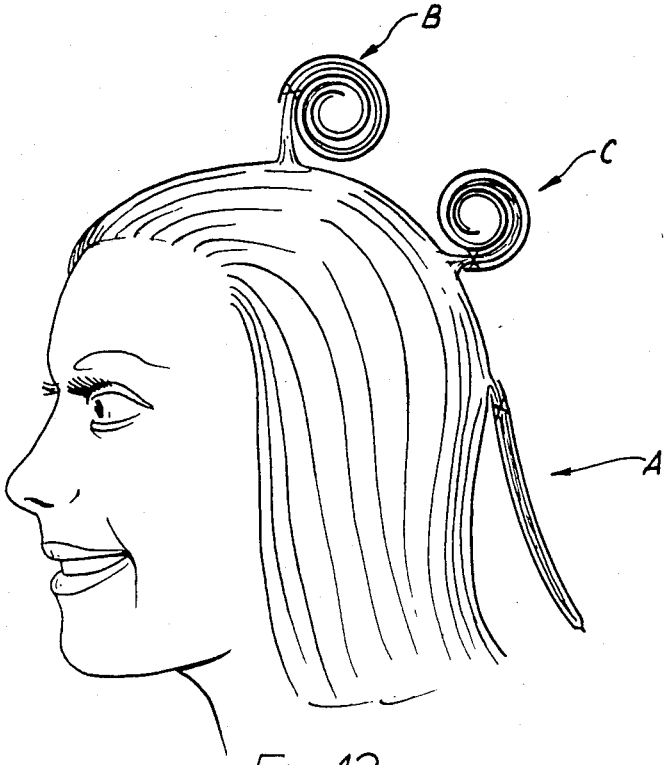
FIG. 13 is a diagrammatic reprsentation showing three different applications of a sheet in accordance with the present invention.

Referring now to FIG. 13, there is shown at A a sheet 1, 21, 25, 31 or 37 when used in a process of coloring selected strands of hair. The sheet has been located under selected strands of hair, a leading edge of the sheet having been located adjacent the scalp, and has then been folded transversely to form an envelope containing the selected strands of hair. The whole of the strands is contained within the envelope. In consequence, the whole of the strands is subjected to the effects of the coloring substance with which the strands have been coated, including the portions of the adhesive in contact with the strands since the adhesive is removed from contact with the strands in the presence of the coloring substance.

An alternative method of application is shown at B in FIG. 13 which is achieved with either of sheets 1 or 21 by rolling the sheet after attachment to selected strands of hair so that the strands are wrapped in rolled materials. The roll is maintained in position by means of the adhesive or the like which contacts an opposite facing surface of the rolled material.

At C in FIG. 13 there is shown a sheet 1, 21, 25, 31 or 37 leading edge of which has been located longitudinally of selected strands in spaced relation from the scalp of the head of hair and thereby leaving exposed lower portions of the strands adjacent the scalp. After formation of an envelope, the envelope is rolled towards the head and secured in the rolled condition by means of hair grips or the like. The lower portions of the strands then are treated with a setting composition while the remaining portions of the strands are shielded from the treating process by being contained within the envelope formed by the sheet.

It will be appreciated that the adhesive 6 of the sheets 1 or 21 may be discontinuous thereby providing spaced portions of adhesive 6. With such an arrangement, an initial selection of strands of hair by weaving may not be necessary because, by applying the sheet 1 or 21 provided with discontinuous portions of adhesive 6 to strands of hair, only some of the strands—the selected strands, i.e., those which adhere to the portions of adhesive 6—will be separated from the remaining strands against which the sheet 1 or 21 was applied if the sheet 1 or 21 subsequently is turned away from the head of hair prior to formation of an envelope 11.

Each of the sheets 1 and 21, if the adhesive 6, 22, 23 thereof is re-usable, may be stored pre-folded in the configuration of the sheets when in use and, when it is intended to use the sheets, the superimposed layers of the sheets are separated one from another.

Preferably, however, the sheets 1 and 21, as with the sheets 25, 31 and 37, will be stored in a flat condition because a hairdresser generally will be using one hand to hold selected strands of hair and will therefore only have the other hand free to apply a masking sheet to the selected strands, and it is difficult to open with one hand only a sheet which has been pre-folded.

Figure 14:
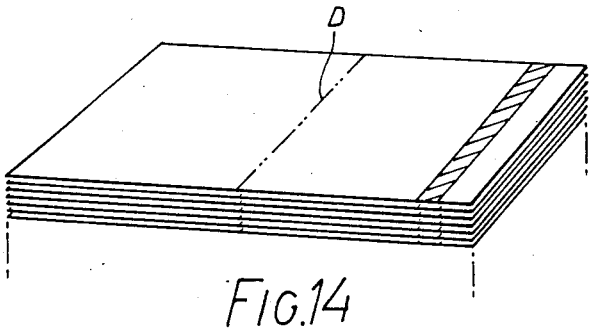
FIG. 14 is a diagrammatic representation of a stack of sheets in accordance with the present invention.

In order to ensure that the sheets 1 and 21 when stored in a stack, as shown in FIG. 14, do not adhere one to another by means of adhesive 6, 22, 23 the reverse surface of the sheet 1, 21, or at least the portion thereof carrying the adhesive, is provided with a release substance, such as silicone. Alternatively, the surface carrying the adhesive is oxidatively treated, such as by subjecting the surface to electronic corona discharge, to key the surface for reception of the adhesive prior to application of the adhesive.

It will be appreciated that the adhesive 6, 22, 23 may be located on either or both surfaces which will be adhesively united one to another.

Each of the sheets 21, 25, 31 and 37, if it does not comprise two panels, is provided with one or more folds, creases or rows of perforations, as shown at D in FIG. 14, along which the sheets easily can be folded, single handed by the hairdresser, to provide the folds 4, 29, 30 and 34.

An advantage of the invention, in addition to rapid and accurate location of masking sheets to selected strands of a head of hair, is that the sheets can be rapidly removed from treated strands of hair. This is achieved because the adhesive which unites with the selected strands of hair is rendered ineffective when in contact therewith by the coloring substance, although other portions of the adhesive will not be contacted by the coloring substance and will remain effective. In consequence, the coloring substance renders adhesive contact with the hair ineffective and the sheets can be rapidly removed from a head of hair after use because the adhesive will present no restraining effect relative to the selected strands of hair, and such removal will not cause discomfort to the person whose hair has been treated.

It will be appreciated that each of the sheets 1, 21, 25, 31 and 37 may be separably joined to corresponding sheets, such as by tear perforations, and wound to form a reel.

It will be understood that the invention is not limited to the embodiments described above, since modifications and other embodiments of the principles of this invention will occur to those skilled in the art to which the invention pertains, particularly upon considering the foregoing teachings. It is, therefore, contemplated by the appended claims to over any such modifications and other embodiments as incorporate those features which constitute the essential features of this invention within the true spirit and scope of the following claims.

What is claimed is:

1. A disposable hairdresser's masking sheet of flexible material for insulating selected strands of a head of hair from other strands of the hair while selected strands are subjected to a colouring agent, said sheet comprising a substrate of flexible material configured as two adjacent portions having a common boundary defined by a hinge about which one of said adjacent portions is pivotable relative to the other so as to encapsulate said selected strands and securing means carried by said substrate and adapted to engage said selected strands, whereby application of the securing means to said selected strands removably unites said sheet with said selected strands.

2. The sheet of claim 1, wherein one said portion is of transparent material so as to permit visual inspection of said selected strands when encapsulated and the other said portion is of less transparent material.

* * * * *